US007942356B2

(12) United States Patent
Dallimore et al.

(10) Patent No.: US 7,942,356 B2
(45) Date of Patent: May 17, 2011

(54) HORIZONTAL SHAFT IMPACT CRUSHER

(75) Inventors: Rowan Dallimore, Bath (GB); Laurent Tisserand, Bichancourt (FR)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/591,873

(22) Filed: Dec. 3, 2009

(65) Prior Publication Data

US 2010/0147985 A1 Jun. 17, 2010

(30) Foreign Application Priority Data

Dec. 15, 2008 (SE) ..... 0802567

(51) Int. Cl.
*B02C 13/286* (2006.01)

(52) U.S. Cl. ..... 241/186.3; 241/189.1; 241/286

(58) Field of Classification Search ..... 241/186.2, 241/186.3, 189.1, 286
See application file for complete search history.

(56) References Cited

U.S. PATENT DOCUMENTS

| | | | |
|---|---|---|---|
| 3,788,562 | A | 1/1974 | Greenlay et al. |
| 6,189,820 | B1 | 2/2001 | Young |
| 2002/0139880 | A1 | 10/2002 | Heukamp |

FOREIGN PATENT DOCUMENTS

| | | |
|---|---|---|
| DE | 39 11 086 | 4/1990 |
| DE | 4312509 | * 10/1994 |
| FR | 2 893 863 | 6/2007 |

* cited by examiner

*Primary Examiner* — Mark Rosenbaum
(74) *Attorney, Agent, or Firm* — Drinker Biddle & Reath LLP

(57) ABSTRACT

A horizontal shaft impact crusher includes a housing, an impeller, and a first and a second curtain against which material accelerated by the impeller may be crushed, the second curtain being located downstream of the first curtain. The housing is provided with a first and a second pivot point for mounting a first end of the first curtain in two different positions relative to the impeller, a first adjustment device for mounting a second end of the first curtain, a third and a fourth pivot point for mounting a first end of the second curtain in two different positions relative to the impeller, and a second adjustment device for mounting a second end of the second curtain.

12 Claims, 6 Drawing Sheets

HORIZONTAL SHAFT IMPACT CRUSHER

CROSS-REFERENCE TO PRIOR APPLICATION

This application claims priority to Sweden Application No. 0802567-8 filed Dec. 15, 2008, which is incorporated by reference herein.

FIELD OF THE INVENTION

The present invention relates to a horizontal shaft impact crusher including a crusher housing having an inlet for material to be crushed, an outlet for material that has been crushed, an impeller being mounted on a horizontal shaft in the crusher housing and being operative for rotating around a horizontal axis, a first curtain against which material accelerated by the impeller may be crushed, and a second curtain against which material accelerated by the impeller may be crushed, the second curtain being located downstream of the first curtain, as seen from the inlet to the outlet.

BACKGROUND OF THE INVENTION

Horizontal shaft impact crushers are utilized in many applications for crushing hard material, such as pieces of rock, ore etc. A horizontal shaft impact crusher has an impeller that is made to rotate around a horizontal axis. Pieces of rock are fed towards the impeller and are struck by beater elements mounted on the impeller. The pieces of rock are disintegrated by being struck by the beater elements, and are accelerated and thrown against breaker plates, often referred to as curtains, against which further disintegration occurs. The action of the impeller thus causes the material fed to the horizontal shaft impact crusher to move freely in a crushing chamber and to be crushed upon impact against the beater elements, against the curtains, and against other pieces of material moving around at high speed in the crushing chamber.

U.S. Pat. No. 6,189,820 discloses a horizontal shaft impact crusher which is provided with a kit of feed plates of different designs. The purpose of the different feed plates is to adapt the crusher to various operating conditions. However, with the design described in U.S. Pat. No. 6,189,820, the crusher is still quite limited in respect of the acceptable variation in the material to be crushed.

SUMMARY

It is an object of the present invention to provide a horizontal shaft impact crusher that can easily be adapted to crush material of a wide range of sizes.

This object is achieved by way of a horizontal shaft impact crusher including a crusher housing having an inlet for material to be crushed, an outlet for material that has been crushed, an impeller being mounted on a horizontal shaft in the crusher housing and being operative for rotating around a horizontal axis, a first curtain against which material accelerated by the impeller may be crushed, and a second curtain against which material accelerated by the impeller may be crushed, the second curtain being located downstream of the first curtain, as seen from the inlet to the outlet, the crusher housing being provided with at least a first pivot point and a second pivot point for mounting a first end of the first curtain in two different positions relative to the impeller, a first adjustment device for mounting a second end of the first curtain, at least a third pivot point and a fourth pivot point for mounting a first end of the second curtain in two different positions relative to the impeller, and a second adjustment device for mounting a second end of the second curtain.

An advantage of this horizontal shaft impact crusher is that it may, in a simple, yet mechanically stable, manner be adapted for various types of material to be crushed. Hence, one and the same crusher may be arranged for primary crushing, secondary crushing, or a combination of both.

According to one embodiment, the first end of the first curtain is located upstream of the second end of the first curtain, as seen from the inlet to the outlet. An advantage of this embodiment is that it becomes easier to ensure that wear plates on the first curtain are arranged aligned with an upper feed plate arranged at the inlet. A further advantage is that the adjustability of the distance between the first curtain and the impeller is largest at that location, i.e., at the downstream second end of the first curtain, where the distance between the first curtain and the impeller is normally the smallest.

According to one embodiment, the first end of the second curtain is located upstream of the second end of the second curtain, as seen from the inlet to the outlet. An advantage, also in this embodiment, is that the adjustability of the distance between the second curtain and the impeller is largest at that location, i.e., at the downstream second end of the second curtain, where the distance between the second curtain and the impeller is normally the smallest.

According to one embodiment, the second pivot point is located closer to the impeller than the first pivot point. According to a further embodiment the fourth pivot point is located closer to the impeller than the third pivot point. An advantage of these embodiments is that the maximum distance between the impeller and the respective curtain will be different depending on which of the pivot points that are utilized at a certain occasion, thereby adapting the crusher for various feed sizes.

According to one embodiment, the crusher has, at least, a first setting in which the first end of the first curtain is mounted in the first pivot point, and the first end of the second curtain is mounted in the third pivot point, a second setting in which the first end of the first curtain is mounted in the second pivot point, and the first end of the second curtain is mounted in the fourth pivot point, and a third setting in which the first end of the first curtain is mounted in the first pivot point, and the first end of the second curtain is mounted in the fourth pivot point. An advantage of this embodiment is that the crusher may be easily arranged to crush large objects to generate objects of an intermediate size, to crush objects of an intermediate size to generate objects of a small size, or to crush, in one single operation, large objects to generate objects of a small size.

According to one embodiment, a first pivot shaft is operative for mounting the first end of the first curtain to the first and second pivot points. According to a further embodiment a second pivot shaft is operative for mounting the first end of the second curtain to the third and fourth pivot points. The first and/or the second pivot shaft is simple from a mechanical point of view, is easy to dismantle when switching from one setting to another, and provides a stable axis around which the first or second curtain may be pivoted.

According to one embodiment, at least one of the first adjustment device and the second adjustment device includes an adjustment bar, which is operative for enabling the adjustment of the distance between the impeller and the second end of the first and the second curtain, respectively. An advantage of this embodiment is that the crushing operation may be fine-tuned by adjusting the exact distance between the impeller and the first and/or the second curtain in a simple manner.

According to one embodiment, the crusher further includes an upper feed plate, the position of which is adjustable, such that the upper feed plate may be arranged in a flush relation with the first curtain. An advantage of this embodiment is that the material fed to the crusher is forwarded into the crusher in an efficient manner, with little risk of damaging unprotected parts of the first curtain.

According to one embodiment, the crusher includes a hydraulic lifting device for moving the first end of the first curtain between the first and the second pivot point. The hydraulic lifting device relieves the physical strain on an operator shifting the positions of the first and second curtains. The hydraulic lifting device could be detachable, such that one hydraulic lifting device could be utilized for moving both the first and the second curtain. The hydraulic lifting device may then be removed from the crusher, before crushing operating begins.

These and other aspects of the invention will be apparent from and elucidated with reference to the claims and the embodiments described hereinafter.

BRIEF DESCRIPTION OF THE DRAWINGS

The invention will hereafter be described in more detail and with reference to the appended drawings.

DETAILED DESCRIPTION OF THE PREFERRED EMBODIMENTS

Figure 1:
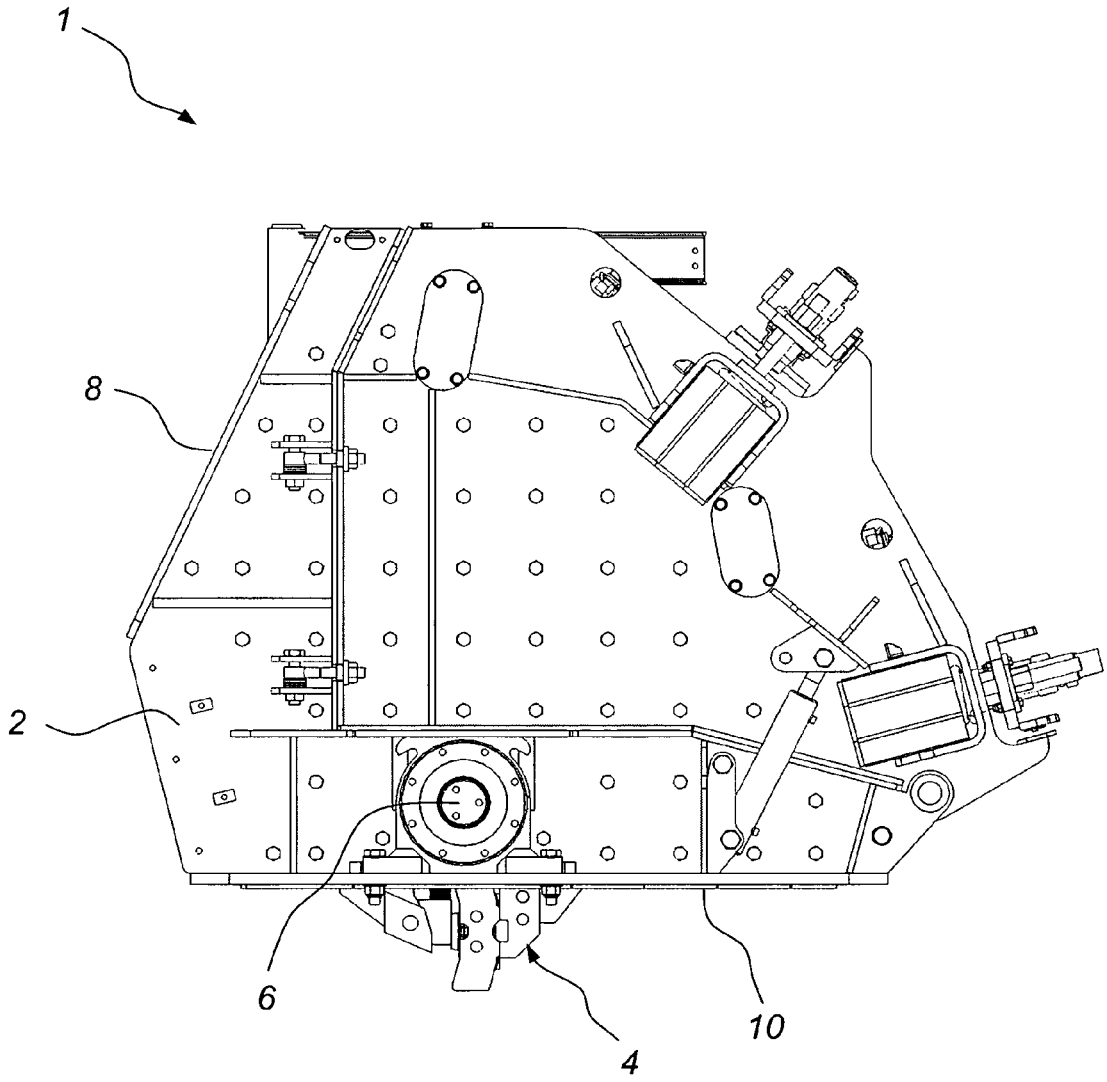
FIG. 1 is a schematic side view of a horizontal shaft impact crusher.

FIG. 1 is a side view and illustrates, schematically, a horizontal shaft impact crusher 1. The horizontal shaft impact crusher 1 includes a housing 2 in which an impeller 4 is arranged. A motor, not illustrated for reasons of maintaining clarity of illustration, is operative for rotating a horizontal shaft 6 on which the impeller 4 is mounted. As alternative to the impeller 4 being fixed to the shaft 6, the impeller 4 may rotate around the shaft 6. In either case, the impeller 4 is operative for rotating around a horizontal axis, coinciding with the center of the horizontal shaft 6.

Material to be crushed is fed to an inlet 8 for material to be crushed. The crushed material leaves the crusher 1 via an outlet 10 for material that has been crushed.

Figure 2:
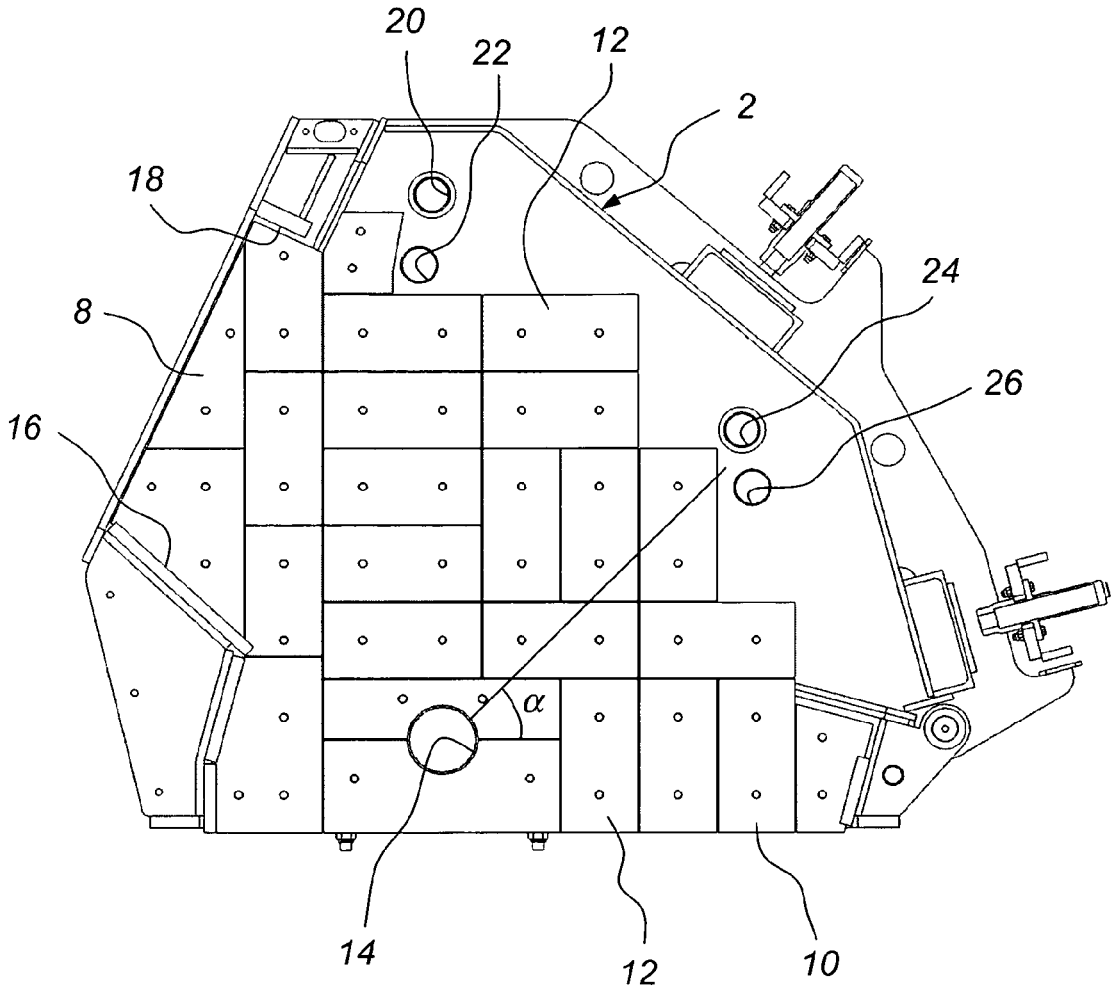
FIG. 2 is a section view and illustrates, schematically, a crusher housing of the crusher of FIG. 1, when in a primary crushing setting.

FIG. 2 is a cross-section and illustrates the housing 2 in more detail. The housing 2 is provided with a plurality of wear protection plates 12 that are operative for protecting the walls of the housing 2 from abrasion and from impact by the material to be crushed. Furthermore, the housing 2 includes a bearing 14 for the horizontal shaft 6, illustrated in FIG. 1. A lower feed plate 16 and an upper feed plate 18 are arranged at the inlet 8. The feed plates 16, 18 are operative for providing the material fed to the crusher 1 with a suitable direction with respect to the impeller 4, illustrated in FIG. 1. In FIG. 2, the feed plates 16, 18 are arranged in a first crushing setting, which can be referred to as a primary crushing setting, in which the crusher is operative for receiving large objects, such as objects having an average diameter of up to 1200 mm, typically objects having an average diameter of 300 to 1200 mm.

Furthermore, the housing 2 is provided with a first pivot point, 20 and a second pivot point 22. The first and second pivot points 20, 22 are typically located almost vertically above the bearing 14 of the horizontal shaft 6, with the second pivot point 22 being located closer to the impeller than the first pivot point 20. Each pivot point 20, 22 has the shape of an opening that is operative for receiving a first pivot shaft, which will be described hereinafter.

The housing 2 is also provided with a third pivot point, 24 and a fourth pivot point 26. The third and fourth pivot points 24, 26 are located at an angle $\alpha$ of about 30-60°, and typically about 45°, to the horizontal plane, as seen with respect to the bearing 14. The fourth pivot point 26 is, in the illustrated embodiment, located closer to the impeller than the third pivot point 24. Each pivot point 24, 26 has the shape of an opening that is operative for receiving a second pivot shaft, which will be described hereinafter.

In the situation illustrated in FIG. 2, the housing 2 is set in a primary crushing setting, as mentioned hereinbefore. In this setting, the first pivot point 20 and the third pivot point 24 are active, as will be described in more detail hereinafter, while the second pivot point 22 and the fourth pivot point 26 are not in use.

Figure 3:
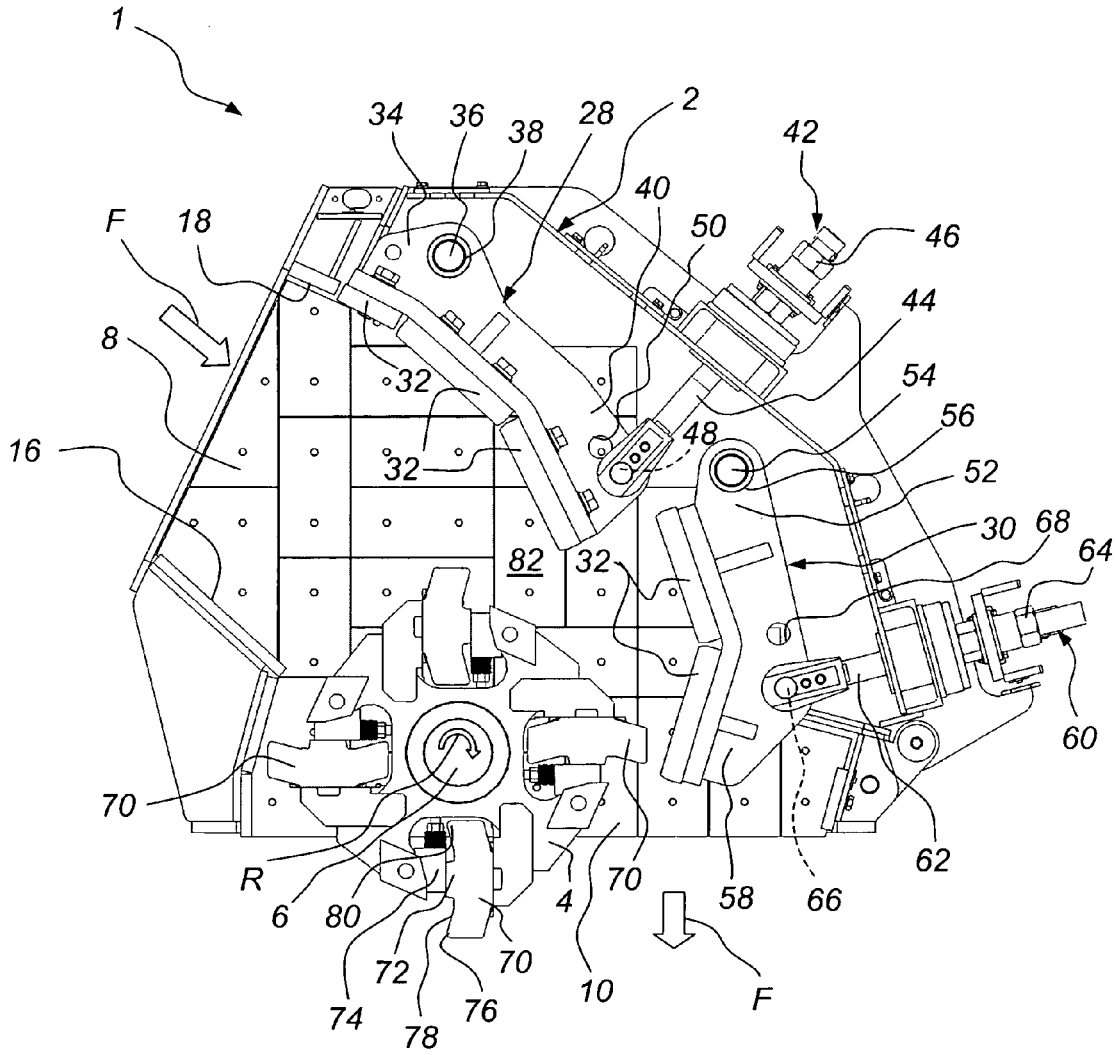
FIG. 3 is a section view and illustrates, schematically, the crusher of FIGS. 1 and 2 in the primary crushing setting.

FIG. 3 illustrates the crusher 1 as seen in cross-section and in the primary crushing setting. The crusher 1 includes a first curtain 28, and a second curtain 30. Each curtain 28, 30 includes at least one wear plate 32 against which material may be crushed.

A first end 34 of the first curtain 28 has been mounted by way of a horizontal first pivot shaft 36 extending through an opening 38 formed in the curtain 28 at the first end 34. The first pivot shaft 36 extends further through the openings in the housing 2 at the first pivot point 20, as previously illustrated with reference to FIG. 2, to suspend the first end 34 in the housing 2. A second end 40 of the first curtain 28 is connected to a first adjustment device 42 including an adjustment bar 44, the longitudinal position of which may be adjusted by way of a nut-arrangement 46. The second end 40 is provided with a first opening 48, which is connected to the adjustment bar 44, and is hidden by the same, in the primary setting illustrated in FIG. 3, and a second opening 50, which is not in use in the primary setting.

A first end 52 of the second curtain 30 has been mounted by way of a horizontal second pivot shaft 54 extending through an opening 56 formed in the curtain 30 at the first end 52. The second pivot shaft 54 extends further through the openings in the housing 2 at the third pivot point 24, as previously illustrated with reference to FIG. 2, to suspend the first end 52 in the housing 2. A second end 58 of the second curtain 30 is connected to a second adjustment device 60 including an adjustment bar 62, the longitudinal position of which may be adjusted by way of a nut-arrangement 64. The second end 58 is provided with a first opening 66, which is connected to the adjustment bar 62, and is hidden by the same, in the primary setting illustrated in FIG. 3, and a second opening 68, which is not in use in the primary setting.

The impeller 4 is provided with four beater elements 70, each such beater element 70 having a "banana" shape, as seen in cross-section. Each beater element 70 has a central portion 72 which is operative for co-operating with a mounting block 74 being operative for pressing the back of the beater element 70 towards the impeller 4 to keep the beater element 70 in position. An arrow R indicates the direction of rotation of the impeller 4. A trailing edge 76 of the beater element 70 extends in the direction of the direction of rotation R, such that a scoop-area 78 is formed between the central portion 72 and the trailing edge 76. The beater element 70 is symmetric around its central portion 72, such that once the trailing edge 76 has been worn out, the beater element 70 can be turned and mounted with its second trailing edge 80 operative for crushing material. The area formed between the impeller 4 and the first and second curtains 28, 30 can be called a crushing chamber 82 of the crusher 1.

In operation, material to be crushed is fed to the inlet 8. As can be seen from FIG. 3, the material will first reach the first curtain 28, being located upstream of the second curtain 30 as seen with respect to the direction of travel of the material. By way of the feed plates 16, 18, the material is directed towards the impeller 4 rotating at, typically, 400-850 rpm. When the material is hit by the beater elements 70, it will be crushed and accelerated against the wear plates 32 of the first curtain 28 where further crushing occurs. The material will bounce back from the first curtain 28 and will be crushed further against material travelling in the opposite direction and, again, against the beater elements 70. When the material has been crushed to a sufficiently small size, it will move further down the crusher chamber 82, and will be accelerated, by way of the beater elements 70, towards the wear plates 32 of the second curtain 30, being located downstream of the first curtain 28. Hence, the material will move freely around in the crushing chamber 82, and will be crushed against the beater elements 70, against the wear plates 32 of the curtains 28, 30, and against other pieces of material circling around, at a high velocity, in the crusher 1. Arrows F indicate the path of the material through the crusher 1. Typically, the material leaving the crusher 1, when in the primary setting, would have an average diameter in the range of 35-300 mm.

As is illustrated in FIG. 3, the first pivot shaft 36 is located upstream of the first adjustment device 42. Thus, it is ensured that the upper feed plate 18 is substantially flush with the wear plates 32, in particular the first wear plate 32 as seen with reference to the path F of the material, of the first curtain 28. The first adjustment device 42 may, on the other hand, be utilized for fine tuning the setting of the first curtain 28. By adjusting the longitudinal position of the bar 44 in relation to the housing 2, the first curtain 28 may be pivoted around the first pivot shaft 36 until an optimum distance between the second end 40 and the impeller 4 has been obtained, with respect to the properties, as regards, e.g., size and hardness, of the material to crushed. Hence, the adjustability of the distance between the first curtain 28 and the impeller 4 is largest at that location, i.e., at the second end 40 of the first curtain 28, where the distance between the first curtain 28 and the impeller 4 is normally the smallest. In a similar manner, the second adjustment device 60 may be utilized for making the second curtain 30 pivot around the second pivot shaft 54 until a suitable distance between the impeller 4 and the second end 58 of the second curtain 30 has been obtained.

It will be appreciated that the first and second pivot points 20, 22, illustrated in FIG. 2, are located upstream of the first adjustment device 42, illustrated in FIG. 3, and that the third and fourth pivot points 24, 26, illustrated in FIG. 2, are located upstream of the second adjustment device 60, illustrated in FIG. 3.

Figure 4:
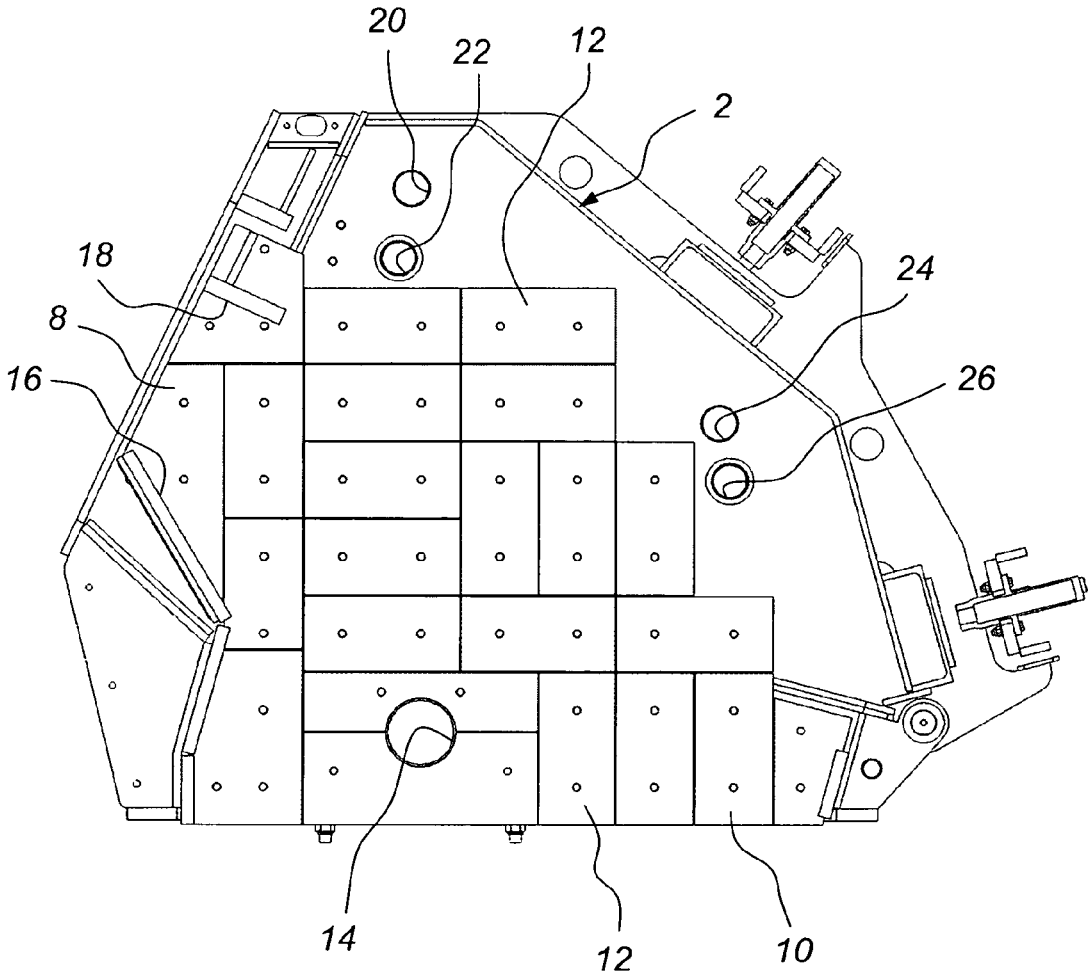
FIG. 4 is a section view and illustrates, schematically, a crusher housing of the crusher of FIG. 1, when in a secondary crushing setting.

FIG. 4 illustrates the crusher housing 2, when the crusher is in a second crushing setting, which can be referred to as a secondary crushing setting, in which the crusher is operative for receiving objects of an intermediate size, such as objects having an average diameter of up to 400 mm, typically objects having an average diameter of 20-400 mm. In FIG. 4, the distance between the lower and upper feed plates 16, 18 has been adjusted to become more narrow compared to what is illustrated in FIGS. 2 and 3, since the crusher is set in the secondary crushing setting. The consequence is that the width of the inlet 8 is much more narrow. The reason is of course that the objects to be crushed are much smaller in the secondary crushing setting. Furthermore, it has been found that a steeper angle of attack, i.e., a steeper angle of feeding the objects towards the impeller 4, is more effective in the secondary crushing. In the secondary crushing setting, the second pivot point 22 and the fourth pivot point 26 are active, as will be described in more detail hereinafter, while the first pivot point 20 and the third pivot point 24 are not in use.

Figure 5:
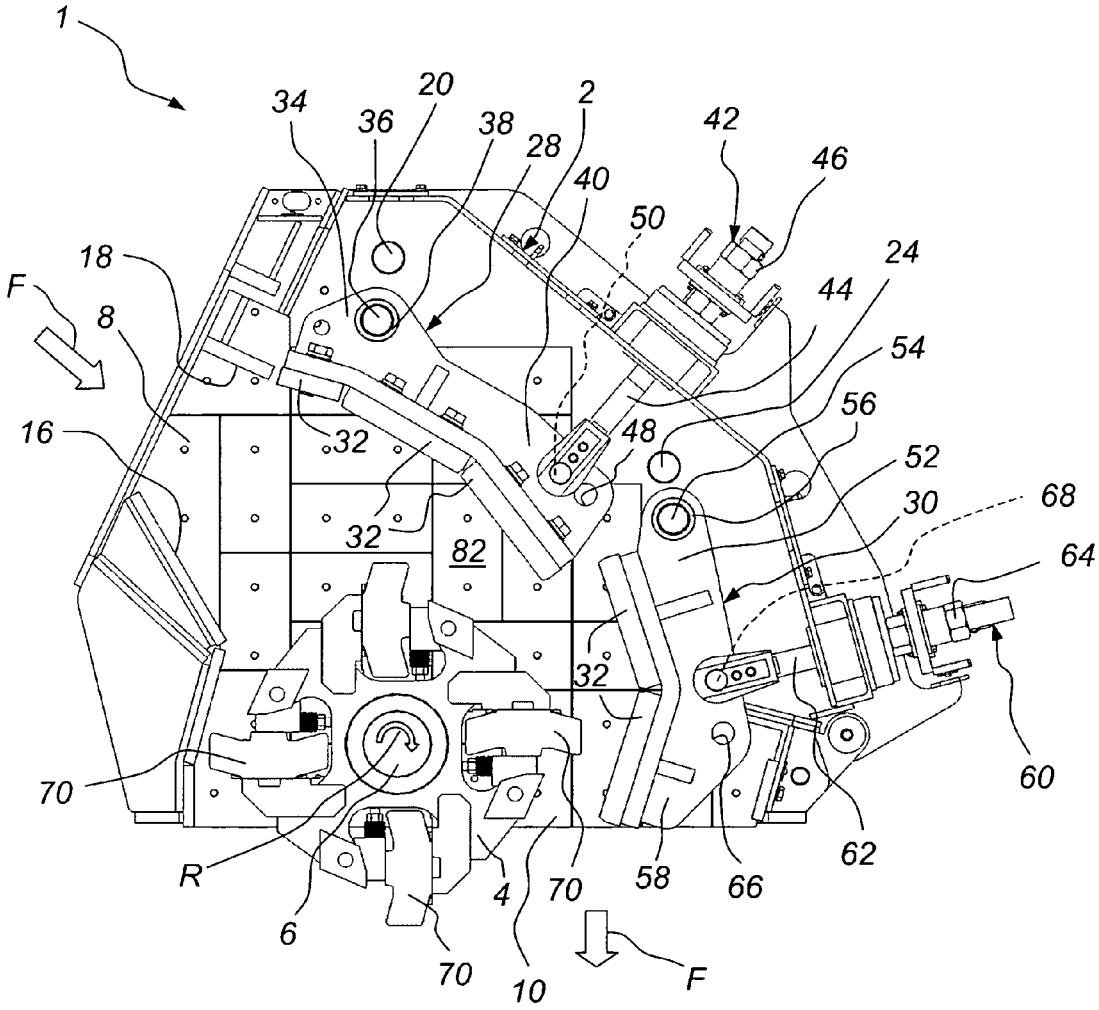
FIG. 5 is a section view and illustrates, schematically, the crusher of FIGS. 1 and 4 in the secondary crushing setting.

FIG. 5 illustrates the crusher 1 as seen in cross-section and in the secondary crushing setting. The first end 34 of the first curtain 28 has been mounted by way of the first pivot shaft 36 extending through the opening 38 formed at the first end 34, and further through the openings in the housing 2 at the second pivot point 22, as previously illustrated with reference to FIG. 4, to suspend the first end 34 in the housing 2. The second end 40 of the first curtain 28 is connected to the first adjustment device 42. The adjustment bar 44 is connected to the second opening 50, illustrated hereinbefore in FIG. 3, of the second end 40, while the first opening 48 is not in use.

The first end 52 of the second curtain 30 has been mounted by way of the second pivot shaft 54 extending through the opening 56 formed in the curtain 30 and further through the openings in the housing 2 at the fourth pivot point 26, as previously illustrated with reference to FIG. 4, to suspend the first end 52 in the housing 2. The second end 58 of the second curtain 30 is connected to the second adjustment device 60. The adjustment bar 62 is connected to the second opening 68, illustrated hereinbefore in FIG. 3, of the second end 58, while the first opening 66 is not in use.

As is illustrated in FIG. 5, the upper feed plate 18 is, in this secondary crushing setting, substantially flush with the wear plates 32, in particular the first wear plate 32 as seen with reference to the path F of material, of the first curtain 28.

In operation, in the secondary crushing setting illustrated in FIG. 5 the material to be crushed is fed to the inlet 8 in a similar manner as has been described hereinbefore with reference to FIG. 3. By way of the feed plates 16, 18, the material is directed towards the impeller 4 rotating at, typically, 400-850 rpm. The rpm may be optimized to fit the conditions of the secondary crushing setting. The material will move freely around in the crushing chamber 82, and will be crushed against the beater elements 70, against the wear plates 32 of the curtains 28, 30, and against other pieces of material circling around, at a high velocity, in the crusher 1. Arrows F indicate the path of the material through the crusher 1. Typically, the material leaving the crusher 1 in the secondary crushing setting would have an average diameter in the range of 5-100 mm.

Figure 6:
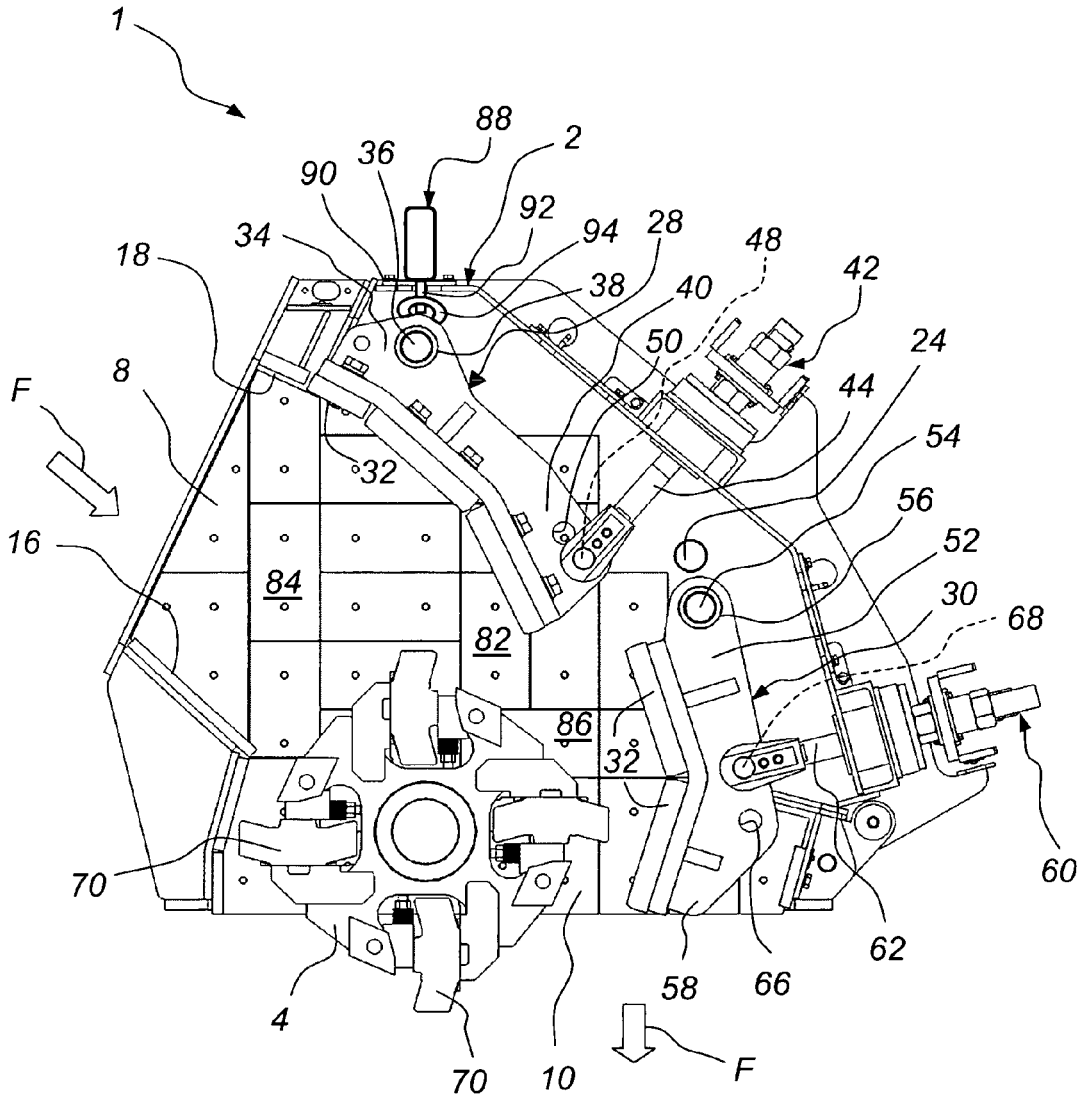
FIG. 6 is a section view and illustrates, schematically, the crusher of FIGS. 1, 2 and 4 in a combined primary and secondary crushing setting.

FIG. 6 illustrates the crusher 1, when the crusher is in a third crushing setting, which can be referred to as a combined primary and secondary crushing setting. In this combined primary and secondary crushing setting, the first pivot point 20 and the fourth pivot point 26, both of which are best shown in FIG. 2 and FIG. 4, are active, as will be described in more detail hereinafter, while the second pivot point 22 and the third pivot point 24 are not in use.

In the combined primary and secondary crushing setting illustrated in FIG. 6, the crushing chamber 82 is in effect divided into two separate crushing zones. A first crushing zone 84 includes the area of the inlet 8, and the area of the first curtain 28. The first crushing zone 84 is, in this setting, operative for receiving large objects, such as objects having an average diameter of up to 1200 mm, typically objects having an average diameter of 300 to 1200 mm, more often an average diameter in the range of 500-1200 mm, and to crush that material according to the principles of primary crushing action. In FIG. 6, the position of the lower and upper feed plates 16, 18 has been adjusted to obtain a width between the lower and upper feed plates 16, 18 which is the same width as illustrated in FIGS. 2 and 3 describing the primary setting, to be able to receive large objects.

As can be seen from FIG. 6, the first end 34 of the first curtain 28 has been mounted by way of the first pivot shaft 36 extending through the opening 38 formed at the first end 34, and further through the openings in the housing 2 at the first pivot point 20, the latter being illustrated with reference to FIG. 2, to suspend the first end 34 in the housing 2. The second end 40 of the first curtain 28 is connected to the first adjustment device 42. The adjustment bar 44 is connected to the first opening 48, illustrated hereinbefore, of the second end 40, while the second opening 50 is not in use.

Furthermore, a second crushing zone 86 includes the area of the second curtain 30. The second crushing zone 86 is, in this setting, operative for receiving intermediate size objects from the first crushing zone 84, such as objects having an average diameter of 100 to 200 mm and to crush that material according to the principles of secondary crushing action.

As can be seen from FIG. 6, the first end 52 of the second curtain 30 has been mounted by way of the second pivot shaft 54 extending through the opening 56 formed in the curtain 30 and further through the openings in the housing 2 at the fourth pivot point 26, as previously illustrated with reference to FIG. 4, to suspend the first end 52 in the housing 2. The second end 58 of the second curtain 30 is connected to the second adjustment device 60. The adjustment bar 62 is connected to the second opening 68, illustrated hereinbefore, of the second end 58, while the first opening 66 is not in use.

In operation in the combined primary and secondary crushing setting illustrated in FIG. 6, the material to be crushed is fed to the inlet 8 in a similar manner as has been described hereinbefore with reference to FIG. 3. By way of the feed plates 16, 18, the material is directed towards the impeller 4 rotating at, typically, 400-850 rpm. The rpm may be optimized to fit the conditions of the combined primary and secondary crushing setting. The material will move freely around in the first crushing zone 84, and will be crushed against the beater elements 70, against the wear plates 32 of the first curtain 28, and against other pieces of material circling around, at a high velocity, in the first crushing zone 84. When the material has been reduced sufficiently in size, it will move further into to the second crushing zone 86, and will be crushed against the beater elements 70, against the wear plates 32 of the second curtain 30, and against other pieces of material circling around, at a high velocity, in the second crushing zone 86. Arrows F indicate the path of the material through the crusher 1. Finally, the material leaving the second crushing zone 86 via the outlet 10 typically has an average diameter in the range of 5-100 mm.

As disclosed hereinabove, the crusher 1 is extremely flexible, and can be utilized for primary crushing of large objects, as disclosed with reference to FIGS. 2-3, or for secondary crushing of smaller objects, as disclosed with reference to FIGS. 4-5, or, as a third alternative, for a combined primary and secondary crushing of large objects to small sizes. Hence, one and the same crusher 1 can be utilized for a wide range of tasks. If, for example, an operator needs to crush a material having an average diameter of about 500 mm to an average diameter of 50 mm, then he may, using only one single crusher, solve this task in two different manners. In accordance with a first alternative embodiment, the operator first arranges the crusher 1 in the primary crushing setting illustrated with reference to FIGS. 2-3, and crushes the material to an average diameter of about 250 mm. The crushed material is put on a pile. Then, when all material has been crushed, the operator arranges the crusher 1 in the secondary crushing setting illustrated with reference to FIGS. 4-5, and feeds the crusher 1 with material from the pile, and crushes it from its average diameter of 250 mm and down to an average diameter of 50 mm. In accordance with a second alternative embodiment, the operator arranges the crusher 1 in the combined primary and secondary crushing setting illustrated in FIG. 6 and crushes the material in one operation, by forwarding it through the first crushing zone 84 and the second crushing zone 86, from its original average diameter of 500 mm and down to an average diameter of 50 mm. The throughput, in tons of material per hour, will be slightly lower in the combined primary and secondary crushing setting illustrated in FIG. 6, but on the other hand there is no need for piling material or to re-arrange the setting. Hence, the crusher 1 is very flexible, and can perform tasks that vary much in respect of the material characteristics at the inlet and at the outlet of the crusher.

It will be appreciated that in each of the settings described hereinbefore with reference to FIGS. 2-6 an operator may fine-tune the exact position of the curtains 28, 30 by way of operating the first and the second adjustment devices 42, 60.

FIG. 6 illustrates an optional hydraulic jack 88 mounted on the roof 90 of the housing 2. The hydraulic jack 88 is provided with a hook 92, that can be made to co-operate with a lug 94 arranged on the first end 34 of the first curtain 28. The hydraulic jack 88 is operated only when an operator has temporarily removed the pivot shaft 36 to move the first curtain 28 from the primary setting to the secondary setting, or vice versa, to facilitate the operators work with such changes of setting. When the crusher 1 is in operation, the hydraulic jack 88 is not in operation, and may be removed. It will be appreciated that a similar hydraulic jack, or even the same hydraulic jack, can be utilized when moving the second curtain 30 between its primary and secondary position.

Hereinbefore, it has been described that the first pivot shaft 36 may be mounted in either the first pivot point 20, or in the second pivot point 22, each such pivot point 20, 22 preferably having the shape of an opening in each side wall of the housing 2 and being operative for receiving a respective end of the first pivot shaft 36. It will be appreciated that further pivot points in which the first pivot shaft 36 may be mounted can be provided. For example, a further pivot point, having the shape of an opening, may be provided between the first and the second pivot points. Similarly, it would also be possible to provide further pivot points for the second pivot shaft 54. Hence, the first end 34 of the first curtain 28 could be mounted in two, three, or more, different positions relative to the impeller 4, and the first end 52 of the second curtain 30 could be mounted in two, three, or more, different positions relative to the impeller 4.

Hereinbefore, it has been described that the crusher 1 is provided with a first curtain 28, and a second curtain 30 located downstream of the first curtain 28. It will be appreciated that a crusher may also be provided with further curtains, such as a third curtain located downstream of the second curtain.

It has been described hereinbefore that the adjustment devices 42, 60 each includes an adjustment bar 44, 62 having a thread in one end and being easily adjustable by way of a nut arrangement 46, 64. It will be appreciated that each of the adjustments devices 42, 60 may also include a spring, to smoothen the forces exerted on the curtains 28, 30 by way of the material in the crushing chamber 82. An entirely mechanical adjustment device 42, 60 is often preferred due its low investment and maintenance costs. It is, however, also possible to utilize other types of adjustment devices, such as hydraulic cylinders.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A horizontal shaft impact crusher, comprising:

a crusher housing having an inlet for material to be crushed and an outlet for material that has been crushed;

an impeller being mounted on a horizontal shaft in the crusher housing and being operative for rotating around a horizontal axis;

a first curtain against which material accelerated by the impeller may be crushed; and a second curtain against which material accelerated by the impeller may be crushed, the second curtain being located downstream of the first curtain, as seen from said inlet to said outlet;

wherein the crusher housing being provided with at least a first pivot point and a second pivot point for mounting a first end of the first curtain in two different positions relative to the impeller, a first adjustment device for mounting a second end of said first curtain, at least a third pivot point and a fourth pivot point for mounting a first end of the second curtain in two different positions relative to the impeller, and a second adjustment device for mounting a second end of said second curtain.

2. The horizontal shaft impact crusher according to claim 1, wherein said first end of said first curtain is located upstream of said second end of said first curtain, as seen from said inlet to said outlet.

3. The horizontal shaft impact crusher according to claim 1, wherein said first end of said second curtain is located upstream of said second end of said second curtain, as seen from said inlet to said outlet.

4. The horizontal shaft impact crusher according to claim 1, wherein said second pivot point is located closer to the impeller than said first pivot point.

5. The horizontal shaft impact crusher according to claim 1, wherein said fourth pivot point is located closer to the impeller than said third pivot point.

6. The horizontal shaft impact crusher according to claim 1, wherein said crusher has, at least, a first setting in which said first end of said first curtain is mounted in said first pivot point, and said first end of said second curtain is mounted in said third pivot point, a second setting in which said first end of said first curtain is mounted in said second pivot point, and said first end of said second curtain is mounted in said fourth pivot point, and a third setting in which said first end of said first curtain is mounted in said first pivot point, and said first end of said second curtain is mounted in said fourth pivot point.

7. The horizontal shaft impact crusher according to claim 1, wherein a first pivot shaft is operative for mounting said first end of said first curtain to said first and second pivot points.

8. The horizontal shaft impact crusher according to claim 1, wherein a second pivot shaft is operative for mounting said first end of said second curtain to said third and fourth pivot points.

9. The horizontal shaft impact crusher according to claim 1, wherein at least one of said first adjustment device and said second adjustment device comprises an adjustment bar, which is operative for enabling the adjustment of the distance between the impeller and said second end of the first and the second curtain, respectively.

10. The horizontal shaft impact crusher according to claim 1, further comprising a hydraulic lifting device for moving said first end of said first curtain between said first and said second pivot point.

11. The horizontal shaft impact crusher according to claim 1, further comprising an upper feed plate, the position of which is adjustable, such that the upper feed plate may be arranged in a flush relation with the first curtain.

12. The horizontal shaft impact crusher according to claim 1, further comprising a hydraulic lifting device for moving said first end of said second curtain between said third and said fourth pivot point.

* * * * *